US009156286B2

(12) United States Patent
Suzuki

(10) Patent No.: US 9,156,286 B2
(45) Date of Patent: Oct. 13, 2015

(54) IMAGE RECORDING DEVICE

(71) Applicant: SEIKO EPSON CORPORATION, Tokyo (JP)

(72) Inventor: Manabu Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/215,757

(22) Filed: Mar. 17, 2014

(65) Prior Publication Data

US 2014/0267521 A1 Sep. 18, 2014

(30) Foreign Application Priority Data

Mar. 18, 2013 (JP) ..... 2013-054690

(51) Int. Cl.
*B41J 11/00* (2006.01)
*B41J 11/04* (2006.01)
*B41J 29/377* (2006.01)

(52) U.S. Cl.
CPC ..... *B41J 11/04* (2013.01); *B41J 29/377* (2013.01)

(58) Field of Classification Search
CPC ..... B41J 11/0015; B41J 11/04; B41J 29/377
USPC ..... 347/102, 104; 34/108
See application file for complete search history.

(56) References Cited

U.S. PATENT DOCUMENTS

| | | | | |
|---|---|---|---|---|
| 5,502,476 | A | 3/1996 | Neal et al. | |
| 6,074,056 | A * | 6/2000 | Kubo et al. | 347/104 |
| 2009/0243207 | A1 * | 10/2009 | Fukui et al. | 271/264 |
| 2010/0073417 | A1 * | 3/2010 | Li et al. | 347/17 |
| 2010/0195130 | A1 * | 8/2010 | Saito | 358/1.12 |
| 2012/0113199 | A1 * | 5/2012 | Edwards | 347/102 |

FOREIGN PATENT DOCUMENTS

| | | |
|---|---|---|
| JP | 63-315270 | 12/1988 |
| JP | 07-276621 | 10/1995 |
| JP | 10-193580 | 7/1998 |
| JP | 11-221914 | 8/1999 |
| JP | 2000-194230 | 7/2000 |
| JP | 2007-101788 | 4/2007 |
| JP | 2009-204749 | 9/2009 |
| JP | 2010-052143 | 3/2010 |

* cited by examiner

*Primary Examiner* — Manish S Shah
*Assistant Examiner* — Roger W Pisha, II
(74) *Attorney, Agent, or Firm* — Workman Nydegger

(57) ABSTRACT

An image recording device includes: a rotating drum configured to rotate and including a cylindrical hollow outer member having an outer peripheral surface around which a recording medium is wrapped during rotation of the rotating drum; an ejecting head facing the outer peripheral surface of the rotating drum and configured to eject liquid onto the recording medium wrapped around the outer peripheral surface of the rotating drum; an air supply unit configured to supply gas from one side of the rotating drum to a hollow portion surrounded by the outer member of the rotating drum in an axial direction along which a rotating shaft of the rotating drum extends; and an exhaust unit configured to exhaust gas from the hollow portion to the other side of the rotating drum in the axial direction.

9 Claims, 6 Drawing Sheets

IMAGE RECORDING DEVICE

BACKGROUND

1. Technical Field

The present invention relates to an image recording device that ejects liquid from an ejecting head onto a recording medium supported on the outer peripheral surface of a rotating drum, and particularly to a technique for cooling the rotating drum.

2. Related Art

U.S. Pat. No. 5,502,476 describes a printer that ejects ink from a print head onto the outer peripheral surface of a drum so as to record an image. In this printer, ink on the drum is cooled and solidified by means of the drum, and then the ink is transferred to a print medium constituting a nip together with the drum, thereby printing an image on the print medium. To cool the ink by means of the drum effectively, the drum is cooled with an airflow generated by a fan. Specifically, the fan axially faces a hollow portion axially penetrating the drum, and generates an airflow that cools the drum while passing through the hollow portion (see FIG. 11).

SUMMARY

Another type of image recording device records an image on a recording medium by ejecting liquid from an ejecting head onto a recording medium wrapped around the outer peripheral surface of a cylindrical platen (a rotating drum). In such an image recording device, when the rotating drum is heated by a heat source located inside the device, the rotating drum thermally expands, and the distance between the rotating drum and the ejecting head varies, resulting in mispositioning of the liquid attached onto the recording medium. To prevent this mispositioning, it is conceivable to cool the rotating drum with a fan by employing the technique of U.S. Pat. No. 5,502,476.

To cool the rotating drum with the fan effectively, however, a large amount of an airflow generated by the fan needs to pass through the hollow portion of the rotating drum quickly so as to promote heat exchange between the airflow and the rotating drum. On the other hand, only generation of an airflow by a fan located at one side of the drum, as described in U.S. Pat. No. 5,502,476, does not easily allow a large amount of an airflow to pass through the hollow portion of the rotating drum quickly, and efficient cooling of the rotating drum can be difficult in some cases.

An advantage of some aspects of the invention is to provide a technique for enabling efficient cooling of a rotating drum in an image recording device that ejects liquid from an ejecting head onto a recording medium supported on the outer peripheral surface of the rotating drum in order to record an image thereon.

An image recording device according to an aspect of the invention includes: a rotating drum configured to rotate and including a cylindrical hollow outer member having an outer peripheral surface around which a recording medium is wrapped during rotation of the rotating drum; an ejecting head facing the outer peripheral surface of the rotating drum and configured to eject liquid onto the recording medium wrapped around the outer peripheral surface of the rotating drum; an air supply unit configured to supply gas from one side of the rotating drum to a hollow portion surrounded by the outer member of the rotating drum in an axial direction along which a rotating shaft of the rotating drum extends; and an exhaust unit configured to exhaust gas from the hollow portion to the other side of the rotating drum in the axial direction.

In the image recording device of this aspect, the rotating drum has the hollow portion surrounded by a cylindrical hollow portion, and the recording medium is wrapped around the outer peripheral surface of the outer member. An image is recorded on the recording medium by ejecting liquid from the ejecting head onto the recording medium wrapped around the outer peripheral surface of the rotating drum. The rotating drum is cooled through cooperation of the air supply unit and the exhaust unit.

Specifically, the air supply unit blows gas from one side in the axial direction of the rotating drum to the hollow portion of the rotating drum. Thus, a large amount of gas can be supplied to the hollow portion of the rotating drum. In addition, the exhaust unit exhausts gas from the hollow portion of the rotating drum to the other side in the axial direction. Thus, gas supplied by the air supply unit from one side in the axial direction is exhausted from the hollow portion to the other side in the axial direction. In this manner, the image recording device supplies a large amount of gas to the hollow portion by means of the air supply unit and, at the same time, promotes passage of the supplied gas through the hollow portion by means of the exhaust unit. As a result, a large amount of gas is quickly generated and is supplied to the hollow portion of the rotating drum so as to cool the rotating drum efficiently.

The image recording device may be configured such that the air supply unit includes an air supply fan oriented in the axial direction at the one side of the rotating drum in the axial direction and configured to draw gas and supply the gas to the hollow portion, and the air supply fan is not located at a side of an imaginary plane including the rotating shaft where the ejecting head is disposed, but is located at the opposite side of the imaginary plane. This configuration can reduce instability of the recording medium facing the ejecting head caused by fanning of the recording medium with air from the air supply fan, thereby stabilizing the location at which liquid ejected from the ejecting head is attached onto the recording medium.

The image recording device may be configured such that the exhaust unit includes a first exhaust fan located at the other side of the rotating drum in the axial direction and oriented in the axial direction, and exhausts gas from the hollow portion by means of the first exhaust fan, and the first exhaust fan is not located at a side of an imaginary plane including the rotating shaft where the ejecting head is disposed, but is located at the opposite side of the imaginary plane. This configuration can reduce instability of the recording medium facing the ejecting head caused by fanning of the recording medium with air from the air supply fan, thereby stabilizing the location at which liquid ejected from the ejecting head is attached onto the recording medium.

The image recording device may be configured such that the image recording device further includes an exterior member housing the rotating drum, the ejecting head, the air supply unit, and the exhaust unit, the air supply unit supplies, to the hollow portion, gas that has been drawn from outside the exterior member through an inlet provided in the exterior member, and the exhaust unit exhausts gas from the hollow portion to outside the exterior member through an outlet provided in the exterior member. In this configuration, outdoor air (gas outside the device) having a relatively low temperature can be drawn and supplied to the hollow portion, thereby enhancing the efficiency of cooling the rotating drum. In addition, gas exhausted from the hollow portion can be released to outside the device, thereby reducing a temperature rise in the device caused by gas heated through heat exchange between the air and the hollow portion of the rotating drum.

The image recording device may be configured such that the inlet faces the hollow portion from the other side of the rotating drum in the axial direction, and the air supply unit draws gas in the axial direction through the inlet. This configuration can efficiently perform both drawing of gas through the inlet and supply of the gas to the hollow portion. As a result, a large amount of outdoor air having a relatively low temperature is easily supplied to the hollow portion, thereby enhancing the efficiency of cooling the rotating drum.

The image recording device may be configured such that the outlet is located at the other side of the rotating drum in the axial direction and is oriented in a horizontal direction perpendicular to the axial direction, the air supply unit includes a second exhaust fan located at the other side of the rotating drum in the axial direction, oriented in the horizontal direction, and facing the outlet, and the air supply unit guides and exhausts gas from the hollow portion to the outlet by means of the second exhaust fan. In this configuration, gas is exhausted from the outlet not in the axial direction of the rotating drum but sideways from the rotating drum. As a result, a job from an operator, for example, can be executed without disturbance of gas from the outlet in a region of the rotating drum in the axial direction side, thereby ensuring this region as a job space by the operator.

The image recording device may be configured such that the second exhaust fan is arranged so as to correspond to an end of the hollow portion in the horizontal direction. This configuration can efficiently discharge air from the hollow portion by means of the exhaust fan.

The image recording device may be configured such that in the axial direction, a maintenance position at which an operator performs maintenance of the ejecting head is provided at a side opposite to the rotating drum relative to a discharge passage of gas in which gas is caused to flow from the hollow portion to the outlet by the exhaust unit, and the ejecting head is movable between the maintenance position and a position facing the rotating drum across the discharge passage in the axial direction. This configuration can allow an operator to perform maintenance of the ejecting head at the maintenance position without disturbance of gas from the outlet.

The image recording device may be configured such that the ejecting head further includes an optical illuminator configured to apply light to the liquid ejected onto the recording medium, the liquid is a photocurable liquid that is cured with generation of heat under application of the light, and the optical illuminator applies the light to a portion of the recording medium wrapped around the rotating drum. In this image recording device, the rotating drum is heated by heat generated during curing of the photocurable liquid to cause a variation of the distance between the rotating drum and the ejecting head. To prevent this variation, the above-described configuration can quickly generate a large amount of an airflow to the hollow portion of the rotating drum in order to enhance the efficiency of cooling the rotating drum.

In particular, since the optical illuminator applies light onto a portion of the recording medium wrapped around the rotating drum, the rotating drum is heated by heat generated during curing of the photocurable liquid to cause a problem of a variation of the distance between the rotating drum and the ejecting head. The above-described configuration can preferably enhance the efficiency of cooling the rotating drum.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
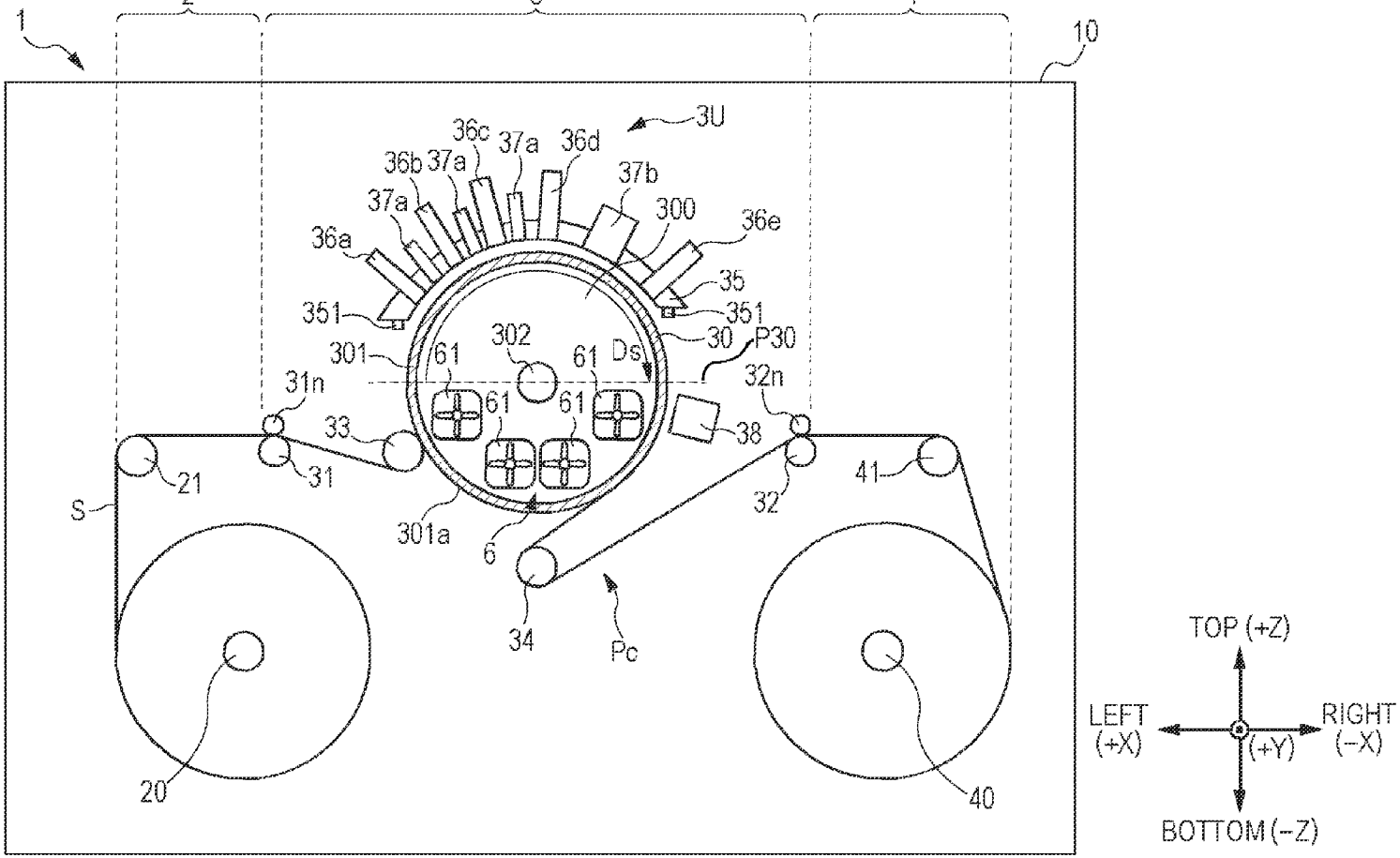
FIG. 1 is a front view schematically illustrating an outline of a configuration of a printer to which the invention is applicable.

FIG. 1 is a front view schematically illustrating an outline of a configuration of a printer to which the invention is applicable. FIG. 1 and the following drawings employ an XYZ orthogonal coordinate system including a lateral direction X, a front-to-back direction Y, and a vertical direction Z of a printer 1 in order to clarify the positional relationship among components of the printer as necessary.

The printer 1 includes a feeder 2, a processor 3, and a winder 4 that are arranged along the lateral direction X and are housed in a housing 10 (an exterior member). The feeder 2 and the winder 4 include a feeder shaft 20 and a winder shaft 40, respectively. A sheet S (a web) is stretched between the feeder shaft 20 and the winder shaft 40 with the two ends of the sheet S being wound into a roll around the feeder shaft 20 and the winder shaft 40. Along a path Pc formed by the stretching, the sheet S is transported from the feeder shaft 20 to the processor 3, subjected to printing by a process unit 3U, and then transported to the winder shaft 40. The type of the sheet S is roughly classified into a paper-based medium and a film-based medium. Specifically, examples of the paper-based medium include wood free paper, cast paper, art paper, and coated paper. Examples of the film-based medium include synthetic paper, polyethylene terephthalate (PET), polypropylene (PP). In the following description, a surface of the sheet S on which an image is to be recorded will be referred to as a front surface, whereas the opposite surface of the sheet S will be referred to as a back surface.

The feeder 2 includes the feeder shaft 20 around which an end of the sheet S is wound, and a follower roller 21 around which the sheet S drawn from the feeder shaft 20 is wrapped. The feeder shaft 20 supports the sheet S with an end of the sheet S being wound around the feeder shaft 20 and the front surface of the sheet S facing outward. The feeder shaft 20 rotates clockwise in FIG. 1 and, thereby, causes the sheet S wound around the feeder shaft 20 to be fed to the processor 3 via the follower roller 21. Here, the sheet S is wound around the feeder shaft 20 with a core tube (not shown) that is removable from the feeder shaft 20 being interposed between the sheet S and the feeder shaft 20. Thus, when the sheet S around the feeder shaft 20 is completely consumed, a new core tube around which a sheet S is wound into a roll is attached to the feeder shaft 20 so that the sheets S around the feeder shaft 20 can be exchanged.

The processor 3 is configured to print an image on a sheet S by performing appropriate processes by the process unit 3U disposed along an outer peripheral surface 301*a* of the rotating drum 30 while supporting the sheet S fed from the feeder 2 on the rotating drum 30. The processor 3 includes a front drive roller 31 and a rear drive roller 32 at both ends of the rotating drum 30 such that the sheet S that is being transported from the front drive roller 31 to the rear drive roller 32 is supported on the rotating drum 30 and an image is printed on the sheet S.

The front drive roller 31 has a plurality of thermally sprayed fine protrusions on the outer peripheral surface thereof, and a sheet S fed from the feeder 2 is wrapped around the front drive roller 31 with the back surface thereof facing the front drive roller 31. The front drive roller 31 rotates clockwise in FIG. 1 and, thereby, causes the sheet S fed from the feeder 2 to be transported downstream in the transport path. A nip roller 31*n* is provided to the front drive roller 31. The nip roller 31*n* is in contact with the front surface of the sheet S while being biased toward the front drive roller 31, and the sheet S is sandwiched between the nip roller 31*n* and the front drive roller 31. In this manner, a friction force occurs between the front drive roller 31 and the sheet S, thereby ensuring transportation of the sheet S by means of the front drive roller 31.

The rotating drum 30 is a cylindrical drum whose center line is in parallel with the direction Y. The rotating drum 30 has a hollow portion 300 penetrating the rotating drum 30 in the axial direction Y, and the sheet S is wrapped around the outer peripheral surface 301*a* of an outer member 301 surrounding the hollow portion 300. The rotating drum 30 includes a rotating shaft 302 extending through the center line of the cylindrical shape of the rotating drum 30 and located in the hollow portion 300. The rotating shaft 302 is rotatably supported by a supporting mechanism (not shown), and the rotating drum 30 rotates about the rotating shaft 302.

The sheet S to be transported from the front drive roller 30 to the rear drive roller 32 is wrapped around the outer peripheral surface 301*a* of the rotating drum 30 with the back surface of the sheet S facing the rotating drum 30. Under a friction force between the rotating drum 30 and the sheet S, the rotating drum 30 supports the sheet S on the back surface thereof while following movement of the sheet S and rotating in a transportation direction Ds along which the sheet S is transported. The processor 3 includes follower rollers 33 and 34 on which the sheet S turns at both ends of the wrapping portion on the rotating drum 30. The front surface of the sheet S is wrapped over the follower roller 33 between the front drive roller 31 and the rotating drum 30 so that the sheet S turns. On the other hand, the front surface of the sheet S is wrapped over the follower roller 34 between the rotating drum 30 and the rear drive roller 32 so that the sheet S turns. In this manner, the sheet S turns upstream and downstream of the rotating drum 30 in the transportation direction Ds, thereby obtaining a long wrapping potion of the sheet S over the rotating drum 30.

The rear drive roller 32 has a plurality of thermally sprayed fine protrusions on the outer peripheral surface thereof, and the sheet S fed from the rotating drum 30 via the follower roller 34 is wrapped around the rear drive roller 32 with the back surface thereof facing the rear drive roller 32. The rear drive roller 32 rotates clockwise in FIG. 1 and, thereby, causes the sheet S to be transported to the winder 4. A nip roller 32*n* is provided to the rear drive roller 32. The nip roller 32*n* is in contact with the front surface of the sheet S while being biased toward the rear drive roller 32, and the sheet S is sandwiched between the nip roller 32*n* and the rear drive roller 32. In this manner, a friction force occurs between the rear drive roller 32 and the sheet S, thereby ensuring transportation of the sheet S by means of the rear drive roller 32.

In the manner described above, the sheet S transported from the front drive roller 31 to the rear drive roller 32 is supported on the outer peripheral surface 301*a* of the rotating drum 30. The processor 3 includes a process unit 3U for printing a color image on the front surface of the sheet S supported on the rotating drum 30. The process unit 3U includes a unit supporter 35 having an arc shape along the outer peripheral surface 301*a* of the rotating drum 30. The unit supporter 35 supports print heads 36*a*-36*e* and UV irradiators 37*a* and 37*b*.

The four print heads 36*a*-36*d* arranged in this order along the transportation direction Ds correspond to yellow, cyan, magenta, and black, and each eject ink of a corresponding color from a nozzle with an ink-jet system. The print heads 36*a*-36*d* are radially disposed about the rotating shaft 302 of the rotating drum 30 and arranged along the outer peripheral surface 301*a* of the rotating drum 30. Each of the print heads 36*a*-36*d* is positioned relative to the rotating drum 30 by the unit supporter 35, and faces the rotating drum 30 with a slight clearance (a platen gap) interposed therebetween. Thus, each of the print heads 36*a*-36*d* faces the front surface of the sheet S wrapped over the rotating drum 30 with a predetermined paper gap interposed between the print head and the sheet S. In this manner, the print heads 36*a*-36*d* eject ink with the paper gap being regulated by the unit supporter 35, thereby causing the ink to be attached onto a desired location on the front surface of the sheet S and to form a color image on the front surface of the sheet S.

Ink to be ejected from the print heads 36*a*-36*d* is, for example, ultraviolet (UV) ink (photocurable ink) that is cured under irradiation with ultraviolet rays (light). In view of this, the process unit 3U includes the UV irradiators 37*a* and 37*b* in order to cure ink and fix the ink on the sheet S. This ink curing is executed in two stages: temporary curing and permanent curing. The UV irradiator 37*a* for temporary curing is provided is each gap between the four print heads 36*a*-36*d*. Specifically, the UV irradiator 37*a* applies relatively weak ultraviolet rays in order to cure ink to a degree at which the ink is not deformed (temporary curing) and is not intended to cure the ink completely. On the other hand, the UV irradiator 37*b* for permanent curing is provided downstream of each of the four print heads 36*a*-36*d* in the transportation direction Ds. Specifically, the UV irradiator 37*b* applies ultraviolet rays stronger than those of the UV irradiator 37*a* in order to cure ink completely (permanent curing). In this manner, the temporary curing and the permanent curing can fix a color images formed by the multiple print heads 36*a*-36*d* on the front surface of the sheet S.

In addition, the print head 36*e* is located downstream of the UV irradiator 37*b* in the transportation direction Ds. The print head 36*e* ejects transparent UV ink from a nozzle with an ink-jet system. The print head 36*e* is positioned relative to the rotating drum 30 by the unit supporter 35, and faces the rotating drum 30 with a slight clearance (a platen gap) interposed therebetween. Thus, the print head 36*e* faces the front surface of the sheet S wrapped over the rotating drum 30 with a predetermined paper gap interposed between the print head 36*e* and the sheet S. In this manner, the print head 36*e* ejects ink with the platen gap being regulated by the unit supporter 35, thereby causing the ink to be attached onto a desired location on the front surface of the sheet S and cover the color image on the front surface of the sheet S with transparent ink.

As described above, the unit supporter 35 is equipped with the print heads 36*a*-36*e* and the UV irradiators 37*a* and 37*b*, and these components constitute the process unit 3U. The unit supporter 35 bridges, in the direction X, between two rails 351 extending in the direction Y, and is moveable on the rails 351 along the direction Y together with the print heads 36*a*-36*e* and the UV irradiators 37*a* and 37*b*. In printing on the sheet S, the unit supporter 35 is positioned at a print position Ta (see FIG. 2) at which the unit supporter 35 faces the rotating drum 30. On the other hand, when an operator is to perform maintenance of the print heads 36*a*-36*e* and the UV irradiators 37*a* and 37*b*, the unit supporter 35 is positioned at a maintenance position Tc (see FIG. 2) at which the unit supporter 35 is displaced from the rotating drum 30 in the direction Y. In this manner, the operator can perform maintenance of the print heads 36*a*-36*e* and the UV irradiators 37*a* and 37*b* at the maintenance position Tc away from the rotating drum 30. Access to the maintenance position Tc by the operator is conducted by opening a door (not shown) at the rear (at the −Y side) of the housing 10.

In addition, in the processor 3, an UV irradiator 38 is provided downstream of the print head 36*e* in the transportation direction Ds. The UV irradiator 38 applies strong ultraviolet rays in order to cure transparent ink ejected from the print head 36*e* completely (permanent curing). In this manner, transparent ink covering the color image can be fixed on the front surface of the sheet S.

The sheet S on which the color image is formed by the processor 3 is transported to the winder 4 through the rear drive roller 32. The winder 4 includes a follower roller 41 over which the sheet S is wrapped with the back surface thereof facing the follower roller 41 between the winder shaft 40 and the rear drive roller 32, in addition to the winder shaft 40 around which an end of the sheet S is wound. The winder shaft 40 supports the sheet S by reeling an end of the sheet S with the front surface of the sheet S facing outward. That is, when the winder shaft 40 rotates clockwise in the drawing sheet of FIG. 1, the sheet S transported from the rear drive roller 32 is reeled by the winder shaft 40 by way of the follower roller 41. The sheet S is reeled by the winder shaft 40 via a core tube (not shown) detachable from the winder shaft 40. Thus, when the amount of the sheet S reeled by the winder shaft 40 becomes full, the sheet S can be removed together with the core tube.

Figure 2:
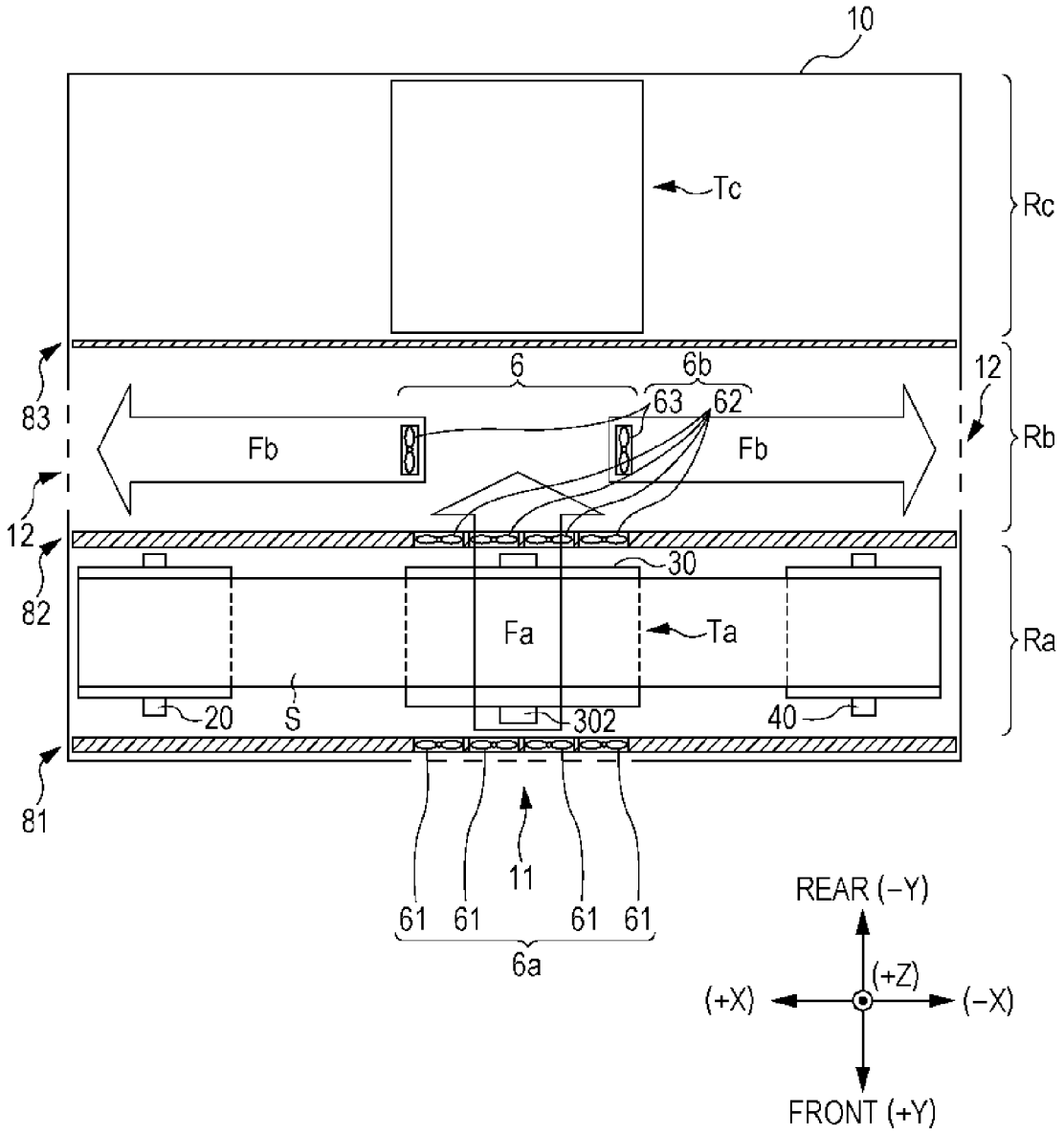
FIG. 2 is a top view schematically illustrating the outline of the configuration of the printer illustrated in FIG. 1.
Figure 3:
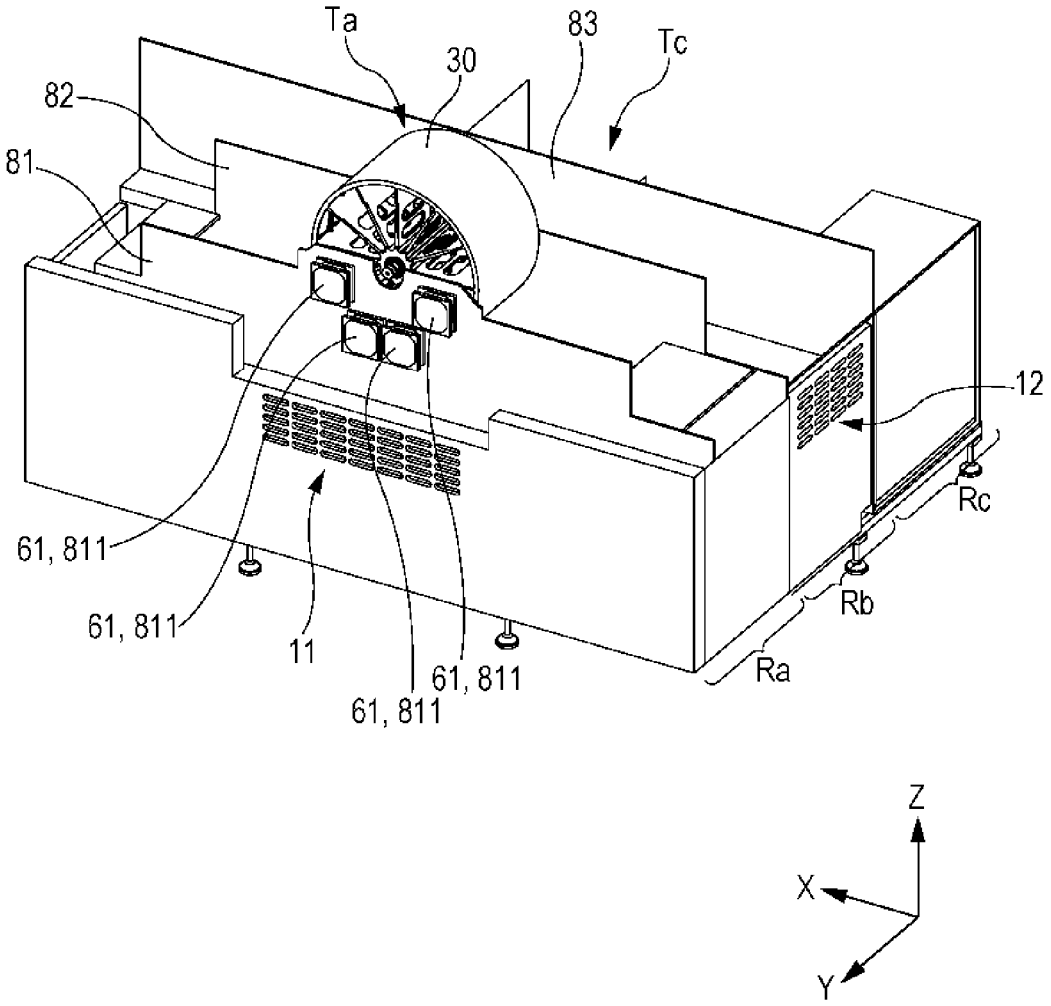
FIG. 3 is a front perspective view schematically illustrating a partial configuration of the printer illustrated in FIG. 1.
Figure 4:
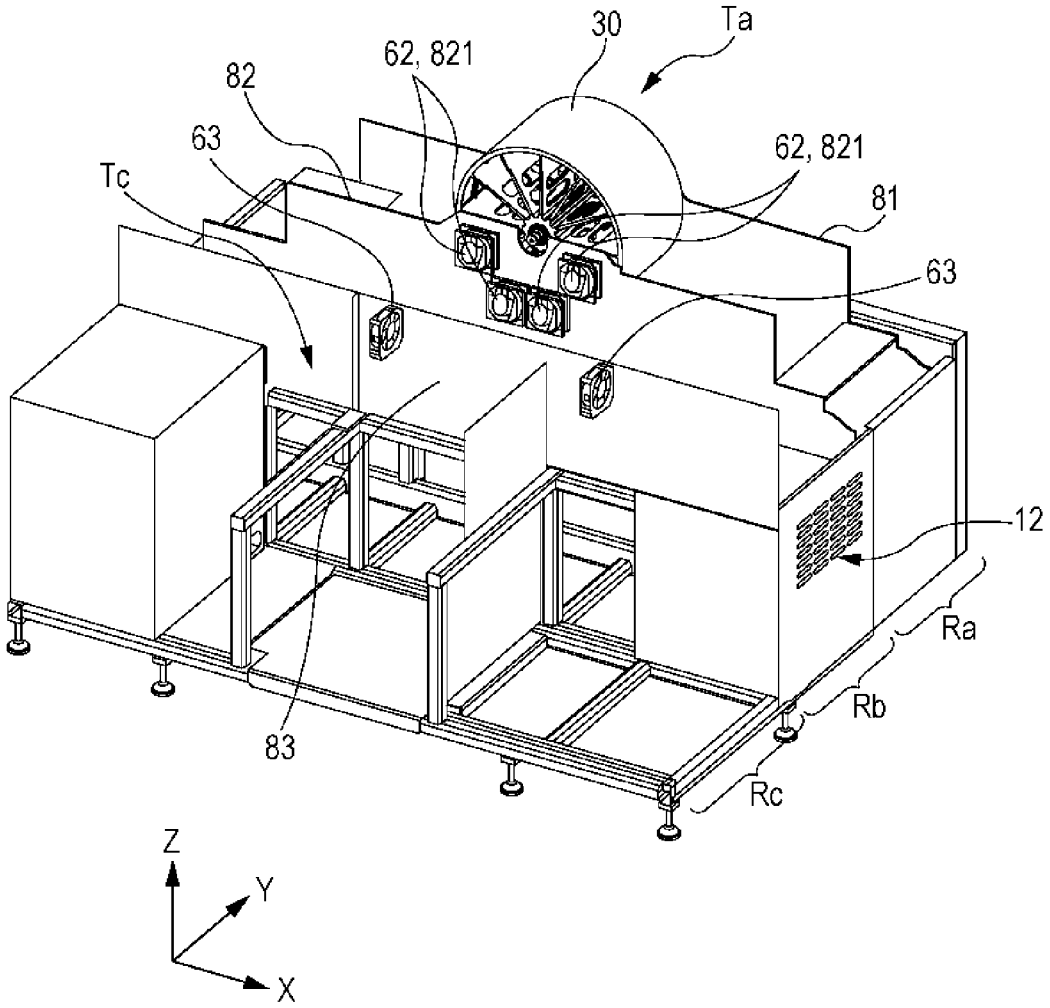
FIG. 4 is a rear perspective view schematically illustrating a partial configuration of the printer illustrated in FIG. 1.

Here, UV ink ejected from the print heads 36*a*-36*e* is cured while generating heat with irradiation with ultraviolet rays. Thus, heat from the UV ink is conducted to the rotating drum 30 through the sheet S, thereby causing thermal expansion of the rotating drum 30. As a result, the distance (the platen gap) between the rotating drum 30 and the print heads 36*a*-36*e* might vary. In particular, as illustrated in FIG. 1, the printer 1 in which the UV lamps 37*a*, 37*b*, and 38 irradiate a portion of the sheet S wrapped over the rotating drum 30 with ultraviolet rays might have a conspicuous problem that heat generated during curing of UV ink heats the rotating drum 30 and causes the platen gap to vary. In addition to heat generated from UV ink, heat generated by the UV lamps 37*a*, 37*b*, and 38 might also heat the rotating drum 30. To solve the problem, the printer 1 includes an airflow generation mechanism that generates an airflow passing through the hollow portion 300 of the rotating drum 30 in order to cool the rotating drum 30. Referring now to FIGS. 2 to 4 in addition to FIG. 1, the following description will be given mainly on the airflow generation mechanism.

FIG. 2 is a top view schematically illustrating the configuration of the printer illustrated in FIG. 1. FIG. 3 is a front perspective view schematically illustrating a partial configuration of the printer illustrated in FIG. 1. FIG. 4 is a rear perspective view schematically illustrating a partial configuration of the printer illustrated in FIG. 1. In FIGS. 3 and 4, the upper part of the housing 10 is not shown in order to illustrate the internal configuration of the printer 1, and internal components such as the process unit 3U and the sheet S are not shown, either. In FIG. 4, the exhaust fans 63 are transparent to the frame member 83.

As clearly illustrated in FIG. 2, the printer 1 includes a print space Ra in which an image is formed on a sheet S, a channel space Rb adjacent to the print space Ra and located at the rear of the print space Ra in the direction Y (i.e., at the −Y side), and a job space Rc adjacent to the channel space Rb and located at the rear of the channel space Rb in the direction Y (i.e., at the −Y side). The airflow generation mechanism 6 discharges an airflow that has passed through the print space Ra including the components (e.g., the rotating drum 30) illustrated in FIG. 1 in the direction Y, through the channel space Rb. Specifically, the airflow generation mechanism 6 includes four air supply fans 61 located at the front of the rotating drum 30 in the axial direction Y (i.e., at the +Y side) and six exhaust fans 62 and 63 at the rear of the rotating drum 30 in the axial direction Y (i.e., at the −Y side).

The four air supply fans 61 are arranged side by side in the direction X below a horizontal imaginary plane P30 including the rotation center line (the center line of the cylindrical shape) of the rotating drum 30 (i.e., at the side opposite to the upper side of the horizontal imaginary plane P30 at which the print heads 36*a*-36*e* are disposed. The air supply fans 61 face the hollow portion 300 in the axial direction Y of the rotating drum 30. The housing 10 has louvers 11 opposed to the hollow portion 300 at the front side (i.e., the +Y side) in the axial direction Y. The air supply fans 61 supply air taken through the louvers 11 from outside the printer 1 to the hollow portion 300 of the rotating drum 30. Among the four air supply fans 61, the intermediate two air supply fans 61 are located below the other two air supply fans 61 at both ends. The four air supply fans 61 are disposed to conform to the shape of the hollow portion 300 as described above, thereby enabling efficient supply of air to the hollow portion 300. In this manner, an air supply unit 6*a* that supplies air (gas) from one side in the axial direction Y (i.e., the +Y side) to the hollow portion 300 of the rotating drum 30 is constituted by the four air supply fans 61.

The six exhaust fans 62 and 63 are also located below the horizontal imaginary plane P30 including the rotation center line of the rotating drum 30. The exhaust fans 62 and 63 discharge air sucked from the hollow portion 300 of the rotating drum 30 to outside the printer 1 through the channel space Rb. Among the six exhaust fans 62 and 63, the four exhaust fans 62 are disposed at the boundary between the print space Ra and the channel space Rb while facing away from the hollow portion 300 of the rotating drum 30 in the axial direction Y. Thus, the exhaust fans 62 discharge air sucked from the hollow portion 300 to the channel space Rb in parallel with the axial direction Y.

On the other hand, the two exhaust fans 63 are arranged so as to correspond to the two ends of the hollow portion 300 in the horizontal direction X perpendicular to the axial direction Y of the rotating drum 30, and individually face outward in the horizontal direction X. Thus, one of the exhaust fans 63 located at the right (the −X side) in the horizontal direction X discharges air sucked from the hollow portion 300 and air discharged from the exhaust fans 62 toward the right (the −X side) in the horizontal direction X along the channel space Rb. The other exhaust fan 63 located at the left (the +X side) in the horizontal direction X discharges air sucked from the hollow portion 300 of the rotating drum 30 and air discharged from the exhaust fans 62 toward the left (i.e., the +X side) in the horizontal direction X along the channel space Rb. The housing 10 has louvers 12 at both ends of the channel space Rb in the horizontal direction X. Air discharged from each of the exhaust fans 63 flows to the outside of the printer 1 through an associated one of the louvers 12. In this manner, an exhaust unit 6*b* that discharges air (gas) from the hollow portion 300 of the rotating drum 30 to the other side (i.e., the −Y side) in the axial direction Y is constituted by the six exhaust fans 62 and 63.

In the manner described above, the airflow generation mechanism 6 including the air supply fans 61 and the exhaust fans 62 and 63 is provided. Thus, in the printer 1, an airflow Fa in which air flows through the hollow portion 300 of the rotating drum 30 in the axial direction Y into the channel space Rb and an airflow Fb in which air that has flown into the channel space Rb from the rotating drum 30 is discharged in the horizontal direction X are created. That is, air drawn from outside the printer 1 moves in the axial direction Y along the airflow Fa, then moves in the horizontal direction X along the airflow Fb, and is released to outside the printer 1. In this process, since the exhaust fans 63 facing in the horizontal direction X are located in front of the airflow Fa, switching of airflow from the airflow Fa to the airflow Fb can be smoothly performed. In this manner, the exhaust fans 63 not only discharge air from the hollow portion 300 of the rotating drum 30 but also function as airflow switching fans for switching the airflow.

The printer 1 also includes frame members 81, 82, and 83 separating the print space Ra, the channel space Rb, and the job space Rc from one another. The frame members 81, 82, and 83 each have an approximately flat plate shape extending in the direction X, and are arranged in this order in the direction Y. The frame member 81 is disposed between the rotating drum 30 and a front portion of the housing 10 at the front (the +Y side) thereof in the direction Y, and has four openings 811 arranged along the direction X between the louvers 11 and the hollow portion 300. The frame member 81 holds the air supply fans 61 individually fitted in the openings 811. The frame member 82 is disposed at the boundary between the print space Ra and the channel space Rb, and has four openings 821 having the hollow portion 300 and arranged along the direction X. The frame member 82 holds the exhaust fans 62 individually fitted in the openings 821. The frame member 82 separates the print space Ra and the channel space Rb from each other so as to block an airflow between the spaces Ra and Rb in portions except the hollow portion 300. The frame member 83 is disposed at the boundary between the channel space Rb and the job space Rc, and separates the channel space Rb and the job space Rc from each other so as to block an airflow between the spaces Rb and Rc.

As described above, the unit supporter 35 is movable in the direction Y together with the print heads 36*a*-36*e* and the UV irradiators 37*a* and 37*b* between the print position Ta of the print space Ra and the maintenance position Tc of the job space Rc. In this manner, to prevent interference with the unit supporter 35 moving across the channel space Rb, the frame members 82 and 83 are configured to be lower than paths along which the components 35, 36*e*-36*e*, 37*a*, and 37*b* move. However, to ensure blocking of an airflow between the spaces Rb and Rc, the frame member 83 is configured to be higher than the exhaust fans 62 and 63. Specifically, the height of the frame members 82 and 83 is equal to the height of the imaginary plane P30 in a region where the frame members 82 and 83 face the rotating drum 30 in the direction Y.

Figure 5:
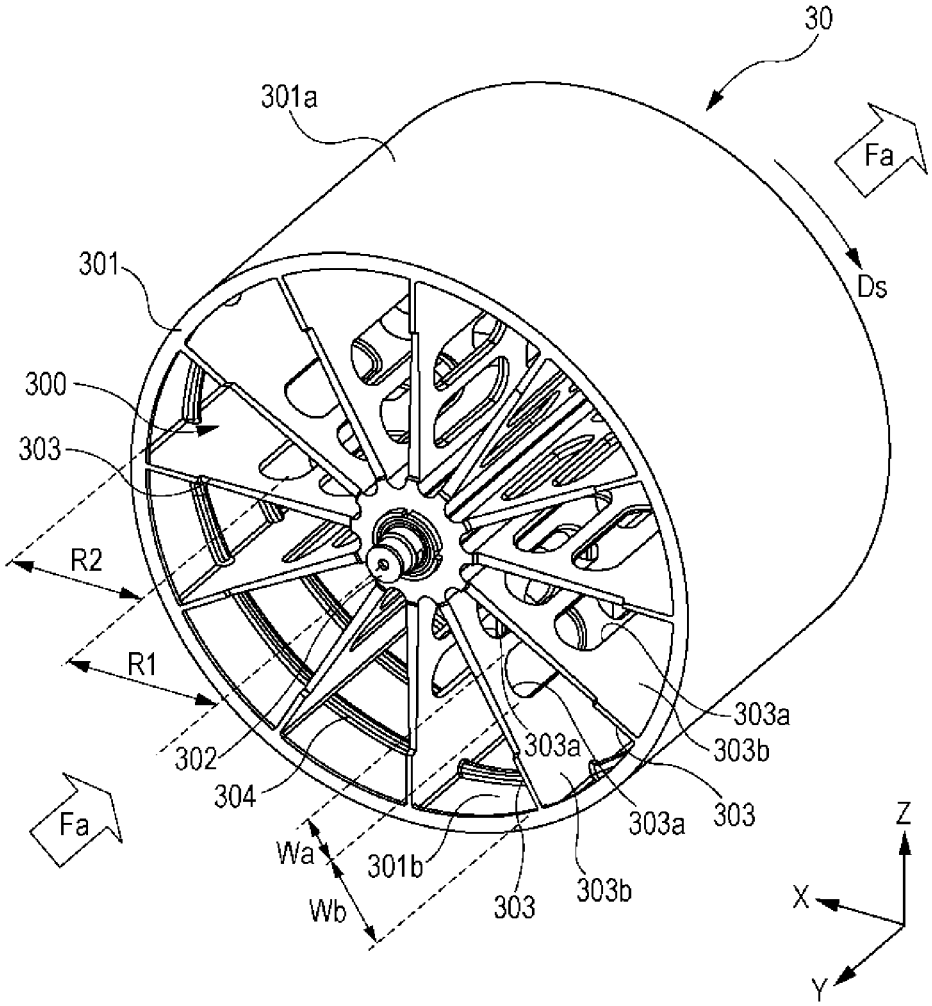
FIG. 5 is a front perspective view partially illustrating a configuration of a rotating drum.

The configuration of the airflow generation mechanism 6 creating the airflows Fa and Fb that cool the rotating drum 30 has been described above. Now, an example of the rotating drum 30 to be cooled by the airflow generation mechanism 6 will be described. FIG. 5 is a front perspective view partially illustrating a configuration of the rotating drum. As described above, the rotating drum 30 includes an outer member 301 (a rim) surrounding the hollow portion 300 penetrating the rotating drum 30 in the axial direction Y and a rotating shaft 302 located in the hollow portion 300 and extending in the axial direction Y. As illustrated in FIG. 5, the rotating drum 30 also includes a plurality of arms 303 (ribs) located in the hollow portion 300, radially extending from the rotating shaft 302 along the radii thereof, and equally spaced one another in the rotational direction Ds (the circumferential direction). An inner peripheral surface 301*b* of the outer member 301 is connected to the rotating shaft 302 through the arms 303. In this manner, the outer member 301 is supported by the arms 303.

Each of the arms 303 has a flat plate shape whose thickness decreases toward the outside along the radial direction of the rotating drum 30, and has the same length as that of the outer member 301 in the axial direction Y. Each of the arms 303 has vents 303*a* penetrating the arm 303 in the rotational direction Ds and each having a slit shape that is long in the axial direction Y and has a width Wa in the radial direction. The vents 303*a* are two-dimensionally arranged such that a plurality of vents 303*a* are provided in each of the axial direction Y and the radial direction in the arm 303. A fin functional portion 303*b* having no vents 303*a* is provided in an outer portion of each of the arms 303. The fin functional portion 303*b* radially extends across the width Wb from the inner peripheral surface 301*b* of the outer member 301 toward the rotating shaft 302, and has a width Wb larger than the width Wa of the vents 303*a*. In the axial direction Y, the fin functional portion 303*b* extends across the overall length of the outer member 301.

In other words, suppose the radius of the rotating drum 30 is r, the vents 303*a* are arranged in the following manner. That is, in the radial direction, the total area of the vents 303*a* in a region R1 of the arm 303 where the distance from the center line of the rotating drum 30 is r/2 or less is larger than the total area of the vents 303*a* in a region R2 of the arm 303 where the distance from the center line of the rotating drum 30 is larger than r/2. In this manner, the vents 303*a* are locally disposed in a region of the arm 303 close to center of the rotating drum 30.

Figure 6:
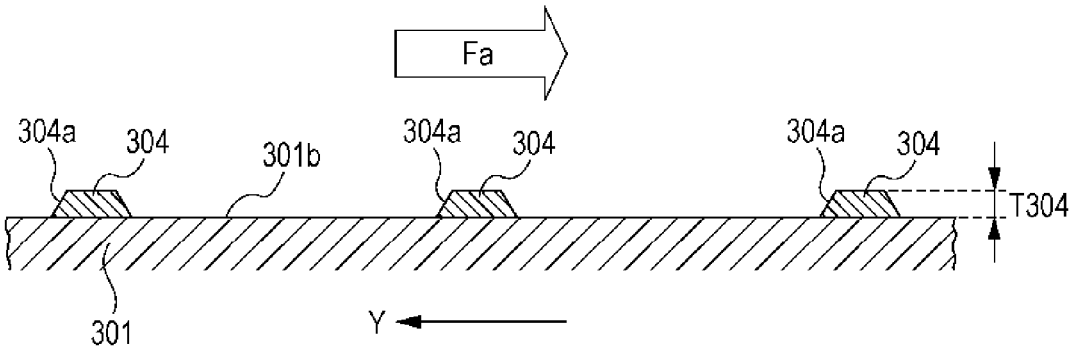
FIG. 6 is a partial sectional view schematically illustrating auxiliary heat dissipating members and taken along a direction Y.

The rotating drum 30 further includes auxiliary heat dissipating members 304 formed on the inner peripheral surface 301*b* of the outer member 301. Each of the auxiliary heat dissipating members 304 has a ring shape forming a circle on the inner peripheral surface 301*b* of the outer member 301 in the rotational direction Ds (the circumferential direction). The auxiliary heat dissipating members 304 are evenly spaced from one another in the axial direction Y, and have cross sectional shapes illustrated in FIG. 6. FIG. 6 is a partial sectional view schematically illustrating the auxiliary heat dissipating members and taken along the direction Y. As illustrated in FIG. 6, the auxiliary heat dissipating members 304 project from the inner peripheral surface 301*b* of the outer member 301, and have an identical thickness T304 on the inner peripheral surface 301*b*. Each of the auxiliary heat dissipating members 304 has a trapezoidal shape that is tapered from the inner peripheral surface 301*b* along the radial direction when viewed in cross section taken along the axial direction Y. That is, each of the auxiliary heat dissipating members 304 has a wall surface 304*a* that is tilted toward the airflow Fa passing through the hollow portion 300 upstream of the airflow Fa.

An airflow Fa generated by an airflow generator 6 passes through the hollow portion 300 of the rotating drum 30 having the configuration as illustrated in FIGS. 5 and 6. Consequently, heat exchange is performed between the airflow Fa and the rotating drum 30 and the rotating drum 30 is cooled, thereby reducing a variation in platen gap (paper gap). In this manner, the location at which ink is attached onto the sheet S is stabilized, thereby enabling formation of an excellent image.

As described above, in the rotating drum 30 of this embodiment, the sheet S is wrapped around the outer peripheral surface 301*a* of the cylindrical hollow outer member 301. The print heads 36*a*-36*e* eject ink onto the sheet S wrapped around the outer peripheral surface 301*a* of the rotating drum 30, thereby recording an image on the sheet S. The rotating drum 30 is cooled through cooperation of the air supply unit 6*a* and the exhaust unit 6*b*.

Specifically, the air supply unit 6*a* supplies air from one side (the +Y side) in the axial direction Y to the hollow portion 300 of the rotating drum 30. In this manner, a large amount of air can be supplied to the hollow portion 300 of the rotating drum 30. In addition, the exhaust unit 6*b* exhausts air to the other side (the −Y side) in the axial direction Y from the hollow portion 300 of the rotating drum 30. In this manner, air supplied from one side (the +Y side) in the axial direction Y by the air supply unit 6*a* is discharged to the other side (the −Y side) in the axial direction Y from the hollow portion 300. Thus, in this embodiment, while a large amount of air is supplied to the hollow portion 300 by the air supply unit 6*a*, passage of the supplied air through the hollow portion 300 is promoted by the exhaust unit 6*b*. As a result, a large amount of an airflow can be quickly generated to the hollow portion 300 of the rotating drum 30 so as to cool the rotating drum 30 efficiency.

In this embodiment, the rotating drum 30, the print heads 36*a*-36*e*, the air supply unit 6*a*, and the exhaust unit 6*b* are housed in the housing 10, and the housing 10 has the louvers 11 for drawing air from the outside and the louvers 12 for discharging air to the outside. The air supply unit 6*a* supplies air taken from outside the housing 10 through the louvers 11 to the hollow portion 300 of the rotating drum 30, whereas the exhaust unit 6*b* discharges air from the hollow portion 300 of the rotating drum 30 to outside the housing 10 through the louvers 12. In this configuration, outdoor air having a relatively low temperature (air outside the housing 10) is drawn and supplied to the hollow portion 300, thereby increasing the efficiency of cooling the rotating drum 30. In addition, air from the hollow portion 300 can be discharged to outside the printer 1, thereby reducing a temperature rise in the printer 1 caused by air heated through heat exchange between the air flow and the rotating drum 30 in the hollow portion 300.

In this case, the louvers 11 face the hollow portion 300 of the rotating drum 30 at one side (the +Y side), and the air supply unit 6*a* draws air through the louvers 11 in the axial direction Y. In particular, the air supply unit 6*a* includes the air supply fans 61 oriented in the axial direction Y between the louvers 11 and the rotating drum 30, and air is drawn by the air supply fans 61 through the louvers 11, and is supplied to the hollow portion 300 of the rotating drum 30. This configuration can efficiently perform both drawing of air through the louvers 11 and supply of the air to the hollow portion 300. As a result, a large amount of outdoor air having a relatively low temperature is easily supplied to the hollow portion 300, thereby enhancing the efficiency of cooling the rotating drum 30.

In this embodiment, the air supply fans 61 is not located at the side (the upper side) of the imaginary plane P30 including the rotation center line of the rotating drum 30 at which the print heads 36*a*-36*e* are disposed, but is located at the opposite side (the lower side) of the imaginary plane P30. This configuration can reduce instability of the sheet S opposed to the print heads 36*a*-36*e* caused by fanning with air from the air supply fans 61, thereby stabilizing the location at which ink ejected from the print heads 36*a*-36*e* is attached onto the sheet S.

In this embodiment, the louvers 12 are located at the opposite side (the −Y side) to the rotating drum 30, and are oriented in the lateral direction X (the horizontal direction) perpendicular to the axial direction Y. The exhaust unit 6*b* discharges air in the lateral direction X through the louvers 12 by the exhaust fans 63 oriented in the lateral direction X. In this configuration, discharge of air from the louvers 12 is directed not to the axial direction Y of the rotating drum 30 but sideways from the rotating drum 30. As a result, in this embodiment, for example, a job from an operator or the like can be executed without disturbance of air from the louvers 12 in a region of the rotating drum 30 toward the axial direction Y, thereby ensuring this region as a job space by the operator.

In particular, in this embodiment, the maintenance position Tc at which the operator performs maintenance of the print heads 36*a*-36*e* is provided at the other side (the −Y side) in the axial direction Y relative to the channel space Rb of air caused to flow from the hollow portion 300 to the louvers 12 by the exhaust unit 6*b*, and the print heads 36*a*-36*e* are movable across the channel space Rb in the axial direction Y between the maintenance position Tc and the location Ta facing the rotating drum 30. In this configuration, the operator can perform maintenance of the print heads 36*a*-36*e* at the maintenance position Tc without disturbance of air from the louvers 12.

In this case, the exhaust unit 6*b* includes the exhaust fans 63 oriented in the lateral direction X and facing the louver 12 at the other side (the −Y side) of the rotating drum 30, and discharges air with the exhaust fans 63 from the hollow portion 300 of the rotating drum 30 through the louvers 12. This configuration can efficiently discharge air from the hollow portion 300 of the rotating drum 30 through the louvers 12 by means of the exhaust fans 63 facing the louvers 12.

In addition, the exhaust fans 63 are arranged so as to correspond to ends of the hollow portion 300 in the lateral direction X. This configuration can efficiently discharge air from the hollow portion 300 with the exhaust fans 63. In particular, the housing 10 has the louvers 12 at both ends in the lateral direction X, and the exhaust fans 63 are arranged so as to correspond to both ends of the hollow portion 300 in the lateral direction X. In this manner, the exhaust fans 63 arranged so as to correspond to the ends of the hollow portion 300 can enhance the discharge efficiency of air from the hollow portion 300.

In this embodiment, the exhaust fans 62 and 63 are not located at the side (i.e., the upper side) the imaginary plane P30 including the rotation center line of the rotating drum 30 at which the print heads 36*a*-36*e* are disposed, but is located at the opposite side (i.e., the lower side) of the imaginary plane P30. This configuration can reduce instability of the sheet S opposed to the print heads 36*a*-36*e* caused by fanning with air from the exhaust fans 62 and 63, thereby stabilizing the location at which ink ejected from the print heads 36*a*-36*e* is attached onto the sheet S.

As described above, in this embodiment, the printer 1 corresponds to an example of the "image recording device" of the invention, the rotating drum 30 corresponds to an example of the "rotating drum" of the invention, the rotating shaft 302 corresponds to an example of the "rotating shaft" of the invention, the hollow portion 300 corresponds to an example of the "hollow portion" of the invention, the outer member 301 corresponds to an example of the "outer member" of the invention, the outer peripheral surface 301*a* corresponds to an example of the "outer peripheral surface" of the invention, the air supply unit 6*a* corresponds to an example of the "air supply unit" of the invention, the air supply fans 61 correspond to an example of the "air supply fan" of the invention, the exhaust unit 6*b* corresponds to an example of the "exhaust unit" of the invention, the exhaust fans 62 correspond to an example of the "first exhaust fan" of the invention, the exhaust fans 63 correspond to an example of the "second exhaust fan" of the invention, the axial direction Y corresponds to an example of the "axial direction" of the invention, the (+Y) side corresponds to an example of the "one side" of the invention, the (−Y) side corresponds to an example of the "other side" of the invention, the housing 10 corresponds to an example of the "exterior member" of the invention, the louvers 11 correspond to an example of the "inlet" of the invention, the louvers 12 correspond to an example of the "outlet" of the invention, the lateral direction X corresponds to an example of the "horizontal direction" of the invention, the channel space Rb corresponds to an example of the "discharge passage" of the invention, the print heads 36*a*-36*e* correspond to an example of the "ejecting head" of the invention, the UV lamps 37*a*, 37*b*, and 38 correspond to an example of the "optical illuminator" of the invention, the sheet S corresponds to an example of the "recording medium" of the invention, and ink corresponds to an example of the "liquid" of the invention.

The invention is not limited to the foregoing embodiment, and various changes may be made to the above descriptions without departing from the scope of the invention. For example, in the above embodiment, heat of reaction during curing of UV ink is adopted as an example of heat that expands the rotating drum 30. However, the heat source for expanding the rotating drum 30 is not limited to UV ink. Thus, the invention is preferably applicable to cases where driving sources such as motors or actuators serve as heat sources. Thus, the invention is also applicable to a printer 1 not using UV ink.

Various changes may also be made to the airflow generation mechanism 6. Thus, the numbers and arrangements, for example, of the air supply fans 61 and the exhaust fans 62 and 63 may be changed as necessary. For example, the orientation of the air supply fans 61 may be changed, the exhaust fans 62 oriented in the axial direction Y may be omitted, and/or the exhaust fans 63 oriented in the lateral direction X may be omitted. Alternatively, the print heads 36*a*-36*e* and the fans 61, 62, and 63 do not need to be opposed to each other with respect to the imaginary plane P30 in the vertical direction Z.

Specific configurations of the opening through which air is drawn into the housing 10 from the outside and the opening through which air is discharged from the housing 10 to the outside are not limited to those of the above-described louvers 11 and 12.

The specific configuration of the rotating drum 30 is not limited to that described above and may be changed as necessary. Accordingly, the vents 303*a* and the auxiliary heat dissipating members 304, for example, do not need to be provided.

In addition, the numbers and arrangements, for example, of the print heads 36*a*-36*e* and the UV lamps 37*a*, 37*b*, and 38 may be changed as necessary. Thus, the UV lamps 37*a*, 37*b*, and 38, for example, do not need to be opposed to the wrapping portion of the sheet S on the rotating drum 30.

The entire disclosure of Japanese Patent Application No. 2013-054690, filed Mar. 18, 2013 is expressly incorporated by reference herein.

What is claimed is:

1. An image recording device, comprising:

a rotating drum configured to rotate and including a cylindrical hollow outer member having an outer peripheral surface around which a recording medium is wrapped during rotation of the rotating drum;

an ejecting head facing the outer peripheral surface of the rotating drum and configured to eject liquid onto the recording medium wrapped around the outer peripheral surface of the rotating drum;

an air supply unit configured to supply gas from one side of the rotating drum to a hollow portion surrounded by the outer member of the rotating drum in an axial direction along which a rotating shaft of the rotating drum extends and configured to cool the outer member of the rotating drum by bringing the gas into contact with an inner peripheral surface of the rotating drum; and an exhaust unit configured to exhaust gas from the hollow portion to the other side of the rotating drum in the axial direction.

2. The image recording device of claim 1, wherein the air supply unit includes an air supply fan oriented in the axial direction at the one side of the rotating drum in the axial direction and configured to draw gas and supply the gas to the hollow portion, and the air supply fan is not located at a side of an imaginary plane including the rotating shaft where the ejecting head is disposed, but is located at the opposite side of the imaginary plane.

3. The image recording device of claim 1, wherein the exhaust unit includes a first exhaust fan located at the other side of the rotating drum in the axial direction and oriented in the axial direction, and exhausts gas from the hollow portion by means of the first exhaust fan, and the first exhaust fan is not located at a side of an imaginary plane including the rotating shaft where the ejecting head is disposed, but is located at the opposite side of the imaginary plane.

4. The image recording device of claim 1, further comprising:

an exterior member housing the rotating drum, the ejecting head, the air supply unit, and the exhaust unit, wherein the air supply unit supplies, to the hollow portion, gas that has been drawn from outside the exterior member through an inlet provided in the exterior member, and the exhaust unit exhausts gas from the hollow portion to outside the exterior member through an outlet provided in the exterior member.

5. The image recording device of claim 4, wherein the inlet faces the hollow portion from the other side of the rotating drum in the axial direction, and the air supply unit draws gas in the axial direction through the inlet.

6. The image recording device of claim 4, wherein the outlet is located at the other side of the rotating drum in the axial direction and is oriented in a horizontal direction perpendicular to the axial direction, the air supply unit includes a second exhaust fan located at the other side of the rotating drum in the axial direction, oriented in the horizontal direction, and facing the outlet, and the air supply unit guides and exhausts gas from the hollow portion to the outlet by means of the second exhaust fan.

7. The image recording device of claim 6, wherein the second exhaust fan is arranged so as to correspond to an end of the hollow portion in the horizontal direction.

8. The image recording device of claim 6, wherein in the axial direction, a maintenance position at which an operator performs maintenance of the ejecting head is provided at a side opposite to the rotating drum relative to a discharge passage of gas in which gas is caused to flow from the hollow portion to the outlet by the exhaust unit, and the ejecting head is movable between the maintenance position and a position facing the rotating drum across the discharge passage in the axial direction.

9. The image recording device of claim 1, wherein the ejecting head further includes an optical illuminator configured to apply light to the liquid ejected onto the recording medium, the liquid is a photocurable liquid that is cured with generation of heat under application of the light, and the optical illuminator applies the light to a portion of the recording medium wrapped around the rotating drum.

* * * * *